US005204158A

United States Patent [19]

Phillips et al.

[11] Patent Number: 5,204,158

[45] Date of Patent: Apr. 20, 1993

[54] IRREGULAR PATTERNED ENTANGLED NONWOVEN FABRICS AND THEIR PRODUCTION

[75] Inventors: Robert L. Phillips, Kendall Park; Connie B. Taylor, Middlesex, both of N.J.; Lauren Jackson, San Clemente, Calif.

[73] Assignee: Chicopee, New Brunswick, N.J.

[21] Appl. No.: 707,521

[22] Filed: May 30, 1991

[51] Int. Cl.[5] ..... B32B 3/10; D04H 1/46

[52] U.S. Cl. ..... 428/134; 28/104; 28/106; 428/187; 428/224

[58] Field of Search ..... 28/104, 106; 428/134, 428/187, 224

[56] References Cited

U.S. PATENT DOCUMENTS

| | | | |
|---|---|---|---|
| 4,190,695 | 2/1980 | Niederhauser | 28/104 |
| 4,693,922 | 9/1987 | Buyofsky et al. | 28/106 |
| 4,718,152 | 1/1988 | Suzuki et al. | 28/104 |
| 4,805,275 | 2/1989 | Suzuki et al. | 28/104 |
| 5,023,130 | 6/1991 | Simpson et al. | 28/104 |

*Primary Examiner*—James C. Cannon

[57] ABSTRACT

An entangled fibre nonwoven fabric containing irregular sized apertures in a random irregular nonrepeating pattern in disclosed. In the method of the invention, a fibrous web is caused to be displaced out of registry with the forming member between fluid impacts by columnar jets of water.

8 Claims, 2 Drawing Sheets

IRREGULAR PATTERNED ENTANGLED NONWOVEN FABRICS AND THEIR PRODUCTION

The invention relates to an entangled nonwoven fabric containing irregular sized apertures in an irregular pattern and to a process for producing it.

BACKGROUND OF THE INVENTION

The fluid entangling of fibers to produce nonwoven fabrics has been commercially practiced for many years. Entangling processes are described in, for instance the following: Evans, U.S. Pat. No. 3,485,706; Evans et al U.S. Pat. No. 3,498,874; and Bunting, U.S. Pat. No. 3,493,462. These patents along with Holmes et al., U.S. Pat. No. 4,379,799 and Holmes et al., U.S. Pat. No. 4,465,726 all show entangled fabrics having a predetermined or regular pattern of holes and hole size. However, they do not provide a description of how to make an entangled nonwoven fabric containing irregular sized apertures arranged in an irregular pattern.

THE PRIOR ART

In Evans, et al U.S. Pat. No. 3,485,706 and U.S. Pat. No. 3,498,874 there is disclosed entangled nonwoven fabric produced by fluid entanglement on a regularly patterned woven carrier belt. In the process described by Evans the fibrous layer is supported on a woven belt throughout the process and the resultant fabric product has a regular pattern of substantially uniform sized holes.

Bunting et al U.S. Pat. No. 3,498,462 discloses a substantially nonpatterned entangled nonwoven fabric and a process for making it. Preferred embodiments provide smooth faced textile fabric having substantially uniformly dense structures. Both Holmes, et al U.S. Pat. No. 4,379,799 and U.S. Pat. No. 4,465,726 use essentially the process of Evans, et al with a specific forming member to produce ribbed terry-like entangled nonwovens of regular pattern.

SUMMARY OF THE INVENTION

In accordance with the present invention, there is provided a nonwoven fabric product having a plurality of substantially uniformly spaced apart continuous strands of entangled staple fibers interconnected at randomly spaced junctures by nonentangled bands of substantially coextensive fibers to define an irregular pattern of irregular sized apertures. The fabric of the invention is produced by a process which includes the following steps:

a. Supporting a layer of fibrous starting material whose individual fibers are in mechanical engagement with one another but which are capable of movement under applied fluid forces, on a fluid pervious open pattern support member adapted to move in a predetermined direction;

b. moving the supported fibrous layer in said predetermined direction to a first entangling zone wherein streams of high pressure, fine, essentially columnar jets of fluid are projected directly onto and through the layer and the pervious pattern support member;

c. moving the supported layer out of the first zone in the predetermined direction toward a second entangling zone;

d. displacing the layer of fibrous starting material on the pattern support layer out of registry with the pattern of the pattern support member;

e. and moving the displaced supported fibrous layer to a second entangling zone wherein streams of high pressure, fine, essentially columnar jets of fluid are projected directly onto and through the fibrous layers and the pervious pattern support member.

DETAILED DESCRIPTION OF THE INVENTION

Evans is U.S. Pat. No. 3,485,706 describes a process and apparatus for entangling fibrous webs by carrying such webs on a woven belt under a series of high pressure, fine, columnar jets of water. The disclosure of Evans is incorporated herein by reference.

Figure 1:
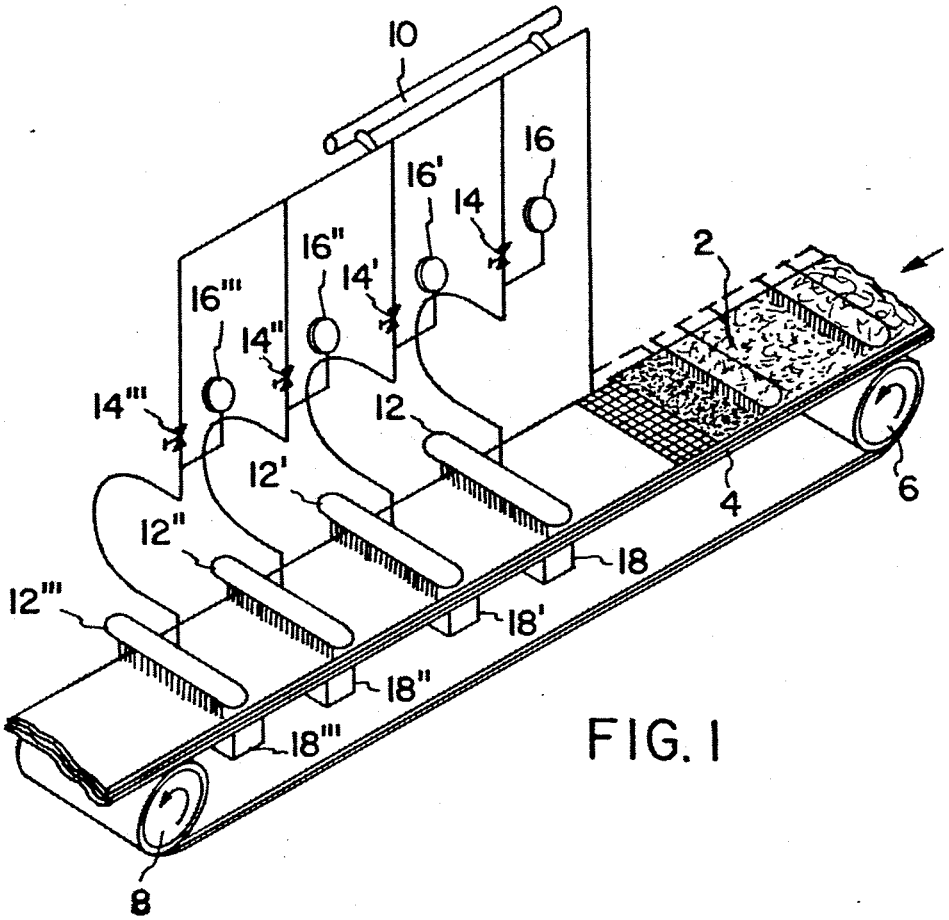
FIG. 1 is a schematic isometric view of an apparatus for carrying out the process of this invention.

Referring to FIG. 1, a fibrous web 2 is supported on an open mesh patterned forming belt 4. The fibrous web may be of any synthetic noncellulosic fiber, preferably polyester. The fibrous web may be prepared by any web forming means, such as textile card, rando webber, or air-laid unit, all of which are well known in the art. The forming belt is driven by roll 6 and supported by idler roll 8. The forming belt must be an "open mesh square pattern such as a 6×8, 12×12, or 14×16. These counts refer to the weave configuration and are well known to one skilled in the art. The forming member should be "open" so as to allow for the movement of the fibrous web on the belt between entangling zones. An insufficiently open belt or belt with insufficient open area causes the web to embed into the mesh of the belt and prevents the required slippage of the web between entangling zones. The fibrous web may weight between 1.9 and 3.0 oz/yd$^2$ (64.4−101.7 g/m$^2$).

High pressure water is supplied by the line 10 from pumps and reservoirs not shown to the manifold 12. The manifold 12 contains orifice strips which produce the fine, columnar jets of water. Each manifold is controlled by a valve 14 to fix the water pressure in the manifold as indicated by the pressure gauge 16. Each manifold has a cooperating vacuum box 18 positioned directly under the orifice strip of the manifold and beneath and in close proximity to the forming belt. Each vacuum box has a slot opening positioned against the underside of the pervious forming belt through which air is drawn by pumps and piping not shown to dewater the web as the water jets impinge on the web. Each manifold with orifice strip and cooperating vacuum box constitutes a forming zone, i.e., 12 and 18 zone 1, 12' and 18' zone 2, etc.

According to the method of this invention the fibrous web 2 is supported on the forming member 4 and is advanced with the forming member in the direction indicated by the arrow by drive means not shown to entangling zone 1 where the fibrous web is subjected to the fine essentially columnar jets of water from the manifold 12. The water jets strike the fibrous web and pass through the pervious forming member into the vacuum box causing the fibers of the web to rearrange their configuration so as to conform and be in registry with the forming member. The fibers are moved predominantly into the open areas of the forming member and partially entangled and moved off the solid portions of the forming member thus forming holes or apertures. The formed fabric is essentially a mirror or reverse image of the forming member as is well know to those skilled in the art.

The driven forming member supporting the web is advanced toward entangling zone 2. At this point by carefully balancing the water pressure in the manifold 12' and the air flow through the vacuum box 18', the partially entangled fibrous web can be made to be displaced forward in the direction of travel and hence to become essentially out of registry with the forming belt. The entire partially formed fabric is not drawn or moved in the direction of travel but only that portion of the partially entangled fabric immediately downstream, i.e., away from the direction of travel of the supporting member is pulled forward, i.e., moved in the direction of travel of the support member at a rate faster than the rate of movement of the supporting member. This micro movement causes the fabric to be slightly bunched on the vacuum slot at the moment of impact of the fine columnar jets of water from manifold 12' on the web. This micro movement also causes drafting of the fibers within the web since the partially entangled fibrous web further downstream remains in contact with the forming member. Drafting is a well known term in the textile industry meaning the slippage of one fiber past another. This temporary elongating or drafting of the partially entangled web causes a momentary web weight reduction. However, when the next subsequent micro movement causes the next portion of the partially entangled web to be displaced forward thus bunched with the proceeding micro portion so that after the subsequent water jet exposure, the fibrous web is essentially at the starting basis weight.

Of importance is that the forward micro movement of the partially entangled web is not uniform and regular. Some portions of the partially entangled web may move a greater or lesser distance than adjoining side to side portions resulting in the random formation of the spaced junctures by nonentangled bands of substantially coextensive fibers and the random apertures.

It is to be appreciated that since the preferred forming member is an open square pattern as previously discussed, when the micro movement occurs that portion of the partially entangled fibrous web that has been a longitudinal strand essentially advances to a portion of the supporting member that causes a longitudinal strand to be formed. This means that the portion of the partially entangled fibrous web which had been a longitudinal strand, although being advanced at a rate faster than the supporting member, essentially lands on a portion of the supporting member that causes it essentially to continue to be a longitudinal strand. However, those substantially coextensive bands of nonentangled fibers extending edge to edge or crosswise of the partially entangled web may be advanced to a like position with respect to the forming member, or more likely to an intermediate position with respect to the repeating pattern of the forming member and hence under the influence of the water jets be rearranged or reformed into a new pattern in accordance with the position with respect to the forming member. For example, if a cross band of coextensive nonentangled fibers were randomly advanced so as to land directly on the high point of the element of the forming member, then under the influence of the water jets the band could be split and caused to form two essentially crosswise parallel bands. This, "out of registry" in the contest of the products and processes of this invention means that a portion of the partially entangled web does not fall on micro forward displacement exactly on the same topographical area of the forming member. The exact balance of water pressure and air flow is not believed to be predictable by direct relationship. Rather, a combination of factors may influence these variables in order to achieve the desired result. However, empirical adjustments of these variables will produce the result of placing the web out of registry.

Having achieved this new positioning with respect to the forming member, the web is subjected to the impact of the fine columnar water jets issuing from the manifold 12'. If desired or required, the previously described procedures may be repeated at entangling zones 3, 4, etc.

Figure 3:
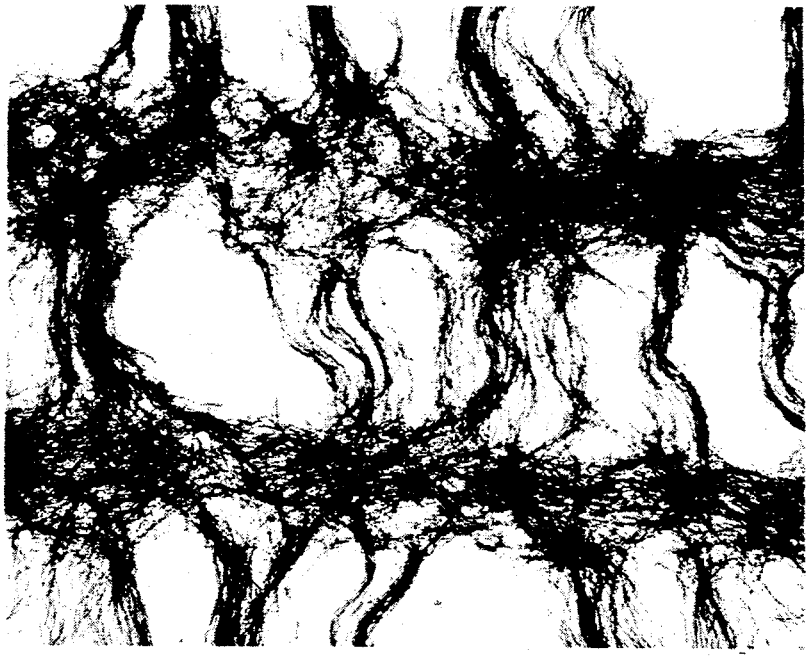
FIG. 3 is a top lighted photomicrograph of 7.5 magnification of the same fabric.
Figure 4:
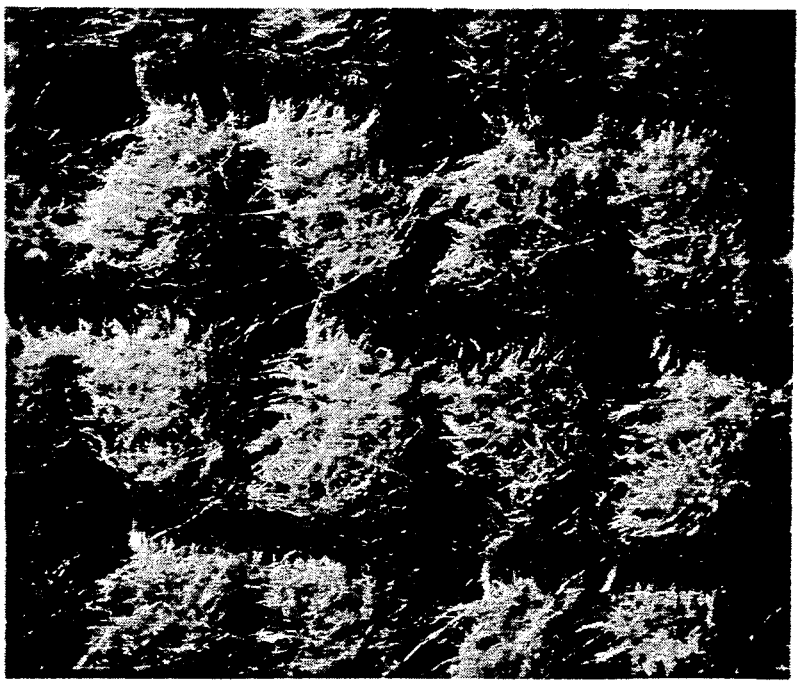
FIG. 4 is a photomicrograph of a prior art fabric produced on the same forming member as the fabric of FIG. 2 and FIG. 3.

The resultant fabric as seen in FIG. 3 and 4 comprises a plurality of substantially uniformly spaced apart continuous strands of entangled stapled fiber 3 interconnected at random spaced junctures 5 by nonentangled bands of substantially coextensive fibers 7 which define holes or apertures of various and irregular sizes in a random or irregular nonrepeating, unordered pattern. The entanglement occurs primarily at junctions 5. The entanglement frequency and location is irregular and random and depends on the uncontrolled process variables of web advancement, jet pressure, etc. The interconnecting bands are essentially coextensive fibers. This means fibers that are essentially nonentangled. The fibers may cross over one another, but for the most part lie in a side-by-side relationship.

At the junctures 5 the fibers are common to strands and bands. A fiber having one end in the band may enter and become entangled in the juncture and thence pass on into an opposite facing band or continue in the strand. A juncture in the strand joins with at least one band but may join with two, three, or more bands.

The invention will be further illustrated in greater detail by the following examples. It should be understood, however, that although the examples may describe in particular detail some of the more specific features of the present invention, they are given primarily for purposes of illustration and the invention in its broader aspect is not construed as limited thereto.

EXAMPLE 1

Figure 2:
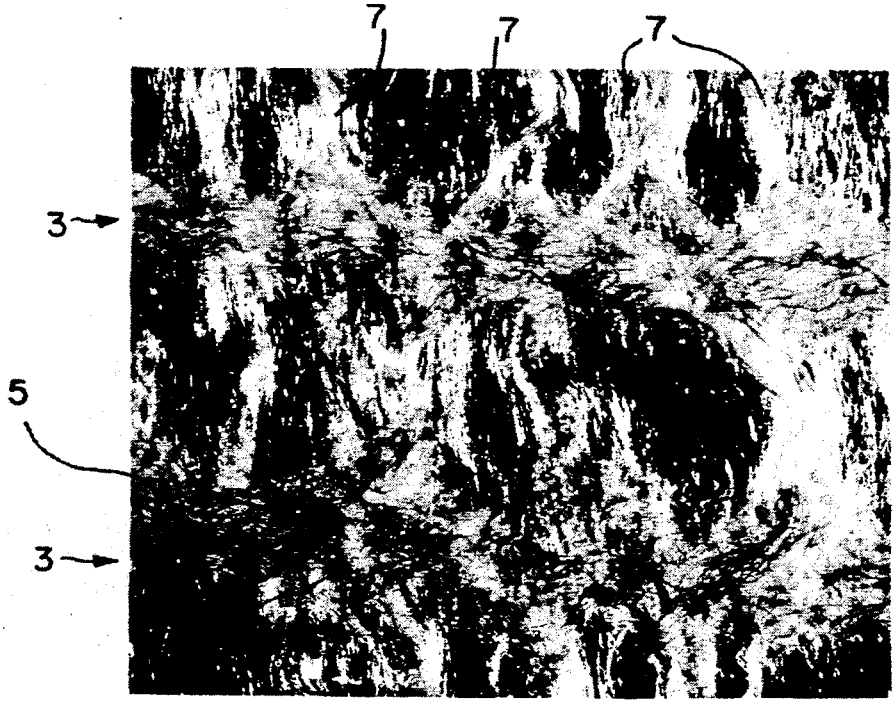
FIG. 2 is a back lighted 7.5 magnification phomicrograph of the fabric of this invention.

A random formed web of polyester fibers of 3d and 1 ½" staple weighing 731 gr/yd$^2$ (56.66 gm/sq/m) is prepared and placed on a 6×8 forming belt supplied by Appleton Wire Works of Appleton, Wis. The belt is a square weave of monofilament polyester. The warp and shute filaments have a diameter of 0.040 inches (0.10 cm) and an open area of 52%. The supported web is subjected to columnar jets of water at 100 lbs/sq. in (0.58 kgms/cm) pressure at zone 1,600 lbs (0.35 kgms) at zone 2,900 lbs (0.52 kgms) at zone 3, and 1200 lbs (70 kgms) at zone 4 with vacuums of 30 inches (76 cms) at zone 1, 20" (51 cm) at zone 2, 10" (25.4 cm) at zone 3, and 5" (12.7 cm) at zone 4. The web is displaced forward and reregistered with the forming belt at the vacuum slot of zones, 2, 3, and 4. The entangled fabric is removed form the forming member and dried. The fabric is as shown in FIG. 2 and 3 and has the following properties:

Weight: 4811 gr/yd$^2$ (37. gm/m$^2$)
Grab Tensiles:
Machine Direction (M/D): 10.2 lbs (4.6 kgms)
Cross Machine Direction (C/D): 8.4 lbs (3.8 kgms)
Elongation: M/D - 79% C/D - 120%
Mullen Burst: 28.5 lbs (12.9 kgms)
1 ply Thickness: 0.037 in (0.094 cm)

EXAMPLE 2

Using the same fibrous web and forming member of Example 1, the web is processed at the following conditions:

| Zone | Jet Pressure | Vacuum |
|---|---|---|
| 1 | 100 lbs/in$^2$ (0.58 kgms/cm$^2$ | 25" of water (.64 cm) |
| 2 | 600 lbs (.35 kgms) | 25" (64 cm) |
| 3 | 1,200 lbs (.70 kgms) | 25" (64 cm) |
| 4 | 1,200 lbs (.70 kgms) | 25" (65 cm) |

The web does not displace in a forward direction but stays in registry with the forming belt and the fabric shown in FIG. 4 which has uniformly sized holes in a regular pattern in produced.

We claim:

1. A nonwoven fabric comprising a plurality of substantially uniformly spaced apart continuous strands of entangled staple fibers interconnected at randomly spaced junctures by nonentangled bands of substantially coextensive fibers to define an irregular pattern of irregular sized apertures.

2. Nonwoven fabric of claim 1 wherein the fabric is made of polyester fiber.

3. Nonwoven fabric of claim 1 wherein said junctures comprise staple fibers common to said strand and to at lease one said band.

4. The method of making a nonwoven fabric which comprises:

a) supporting a layer of fibrous starting material whose individual fibers are in mechanical engagement with one another but which are capable of movement under applied fluid forces, on a fluid pervious patterned support member adapted to move in a predetermined direction;

b) moving the supported layer in said predetermined direction to a first entangling zone wherein streams of high pressure, fine, essentially columnar jets of fluid are projected directly onto and through said layer and said pervious patterned support member;

c) moving the said supported layer out of said first zone in said predetermined direction toward a second entangling zone;

d) displacing the said layer of fibrous starting material on said patterned support member out of registry with the pattern of said patterned support member; and e) moving the said displaced supported fibrous layer to said second entangling zone wherein streams of high pressure, fine, essentially columnar jets of fluid are projected directly onto and through said layer and said pervious patterned support member.

5. The method of claim 4 wherein said fluid is water.

6. The method of claim 4 wherein said layer of fibrous starting material comprises polyester fiber.

7. The method of claim 4 wherein said support member comprises an open mesh belt.

8. The method of claim 4 wherein steps (c), (d), and (e) are repeated at least once.

* * * * *